US009091520B2

(12) United States Patent
Muller et al.

(10) Patent No.: US 9,091,520 B2
(45) Date of Patent: Jul. 28, 2015

(54) DETONATION OF EXPLOSIVES

(75) Inventors: Elmar Muller, Centurion (ZA); Pieter Stephanus Jacobus Halliday, Randburg (ZA); Clifford Gordon Morgan, Kempton Park (ZA); Paul Dastoor, Callaghan (AU); Warwick Belcher, Callaghan (AU); Xiaojing Zhou, Callaghan (AU); Glenn Bryant, Callaghan (AU)

(73) Assignee: AEL MINING SERVICES LIMITED, Woodmead, Sandton (ZA)

( * ) Notice: Subject to any disclaimer, the term of this patent is extended or adjusted under 35 U.S.C. 154(b) by 0 days.

(21) Appl. No.: 13/992,790

(22) PCT Filed: Dec. 9, 2011

(86) PCT No.: PCT/IB2011/055573

§ 371 (c)(1),
(2), (4) Date: Jun. 10, 2013

(87) PCT Pub. No.: WO2012/077082

PCT Pub. Date: Jun. 14, 2012

(65) Prior Publication Data

US 2013/0255520 A1 Oct. 3, 2013

(30) Foreign Application Priority Data

| | | |
|---|---|---|
| Dec. 10, 2010 | (ZA) | 10/8925 |
| Dec. 10, 2010 | (ZA) | 10/8926 |
| Dec. 10, 2010 | (ZA) | 10/8927 |
| Feb. 21, 2011 | (ZA) | 11/1370 |

(51) Int. Cl.
*F42D 1/05* (2006.01)
*F42B 3/18* (2006.01)

(Continued)

(52) U.S. Cl.
CPC ... *F42D 1/05* (2013.01); *F42B 3/18* (2013.01); *F42C 19/12* (2013.01); *F42B 3/12* (2013.01); *F42B 3/121* (2013.01); *F42B 3/22* (2013.01)

(58) Field of Classification Search
CPC ..... F42B 3/12; F42B 3/18; F42B 3/121; F42B 3/22; F42C 19/12; F42D 1/05
USPC ..... 102/200, 201, 202.1, 202.5, 202.7, 206, 102/215, 217, 218, 262, 301, 311, 312, 313, 102/314, 322
See application file for complete search history.

(56) References Cited

U.S. PATENT DOCUMENTS

| | | | |
|---|---|---|---|
| 3,837,282 | A | 9/1974 | Morrow |
| 4,020,765 | A | 5/1977 | Glass et al. |

(Continued)

FOREIGN PATENT DOCUMENTS

| | | |
|---|---|---|
| DE | 195 46 823 | 6/1997 |
| EP | 0 207 749 | 1/1987 |

(Continued)

OTHER PUBLICATIONS

PCT/IB2012/050757 International Search Report dated May 8, 2012 (2 pages).

(Continued)

*Primary Examiner* — James S Bergin
(74) *Attorney, Agent, or Firm* — Brinks Gilson & Lione; G. Peters Nichols

(57) ABSTRACT

An explosives detonator system for detonating an explosive charge with which it is, in use, arranged in a detonating relationship is provided. On acceptance of a detonation initiating signal having a detonation initiating property, the system initiates and thus detonates the explosive charge. The system includes an initiating device which accepts the detonation initiating signal and initiates and thus detonates the explosive charge. The initiating device is initially in a non-detonation initiating condition, in which it is not capable of accepting the detonation initiating signal. The system also includes a radio frequency identification (RFID) based switching device that detects a switching property of a radio switching signal that is transmitted to the detonator system and switches the initiating device, on detection of the detonation initiating property, to a standby condition in which the initiating device is capable of operatively accepting the detonation initiating signal when it is transmitted thereto.

9 Claims, 1 Drawing Sheet

Figure 1:
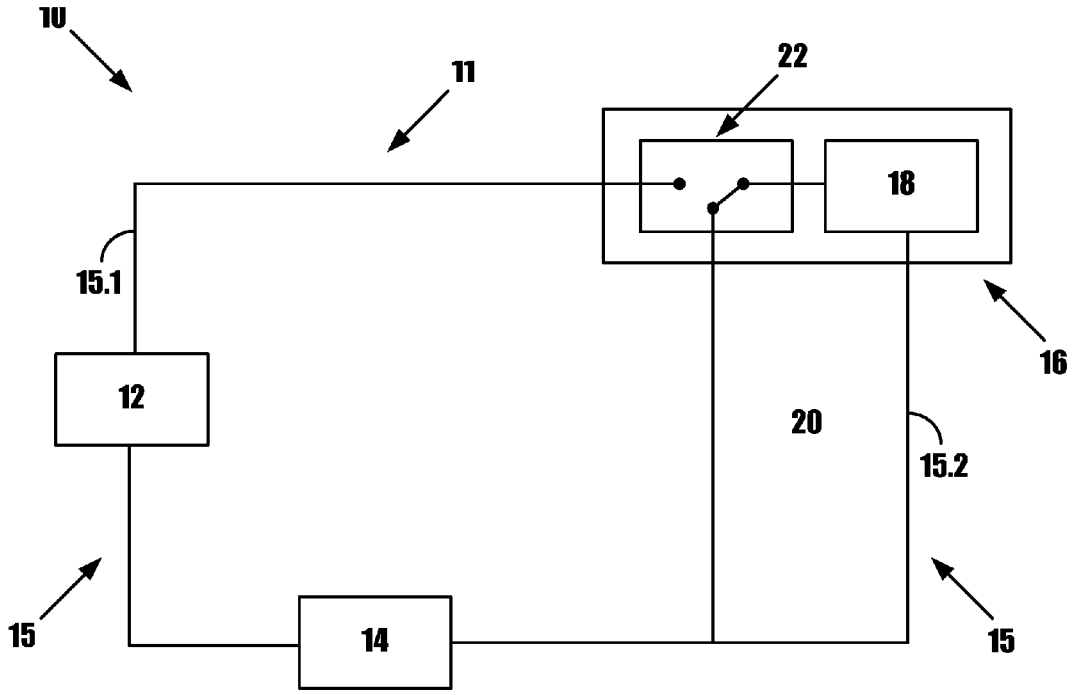

(51) Int. Cl.

| | |
|---|---|
| ***F42B 3/12*** | (2006.01) |
| ***F42B 3/22*** | (2006.01) |
| ***F42C 19/12*** | (2006.01) |

(56) References Cited

U.S. PATENT DOCUMENTS

| | | | | |
|---|---|---|---|---|
| 4,700,629 | A | 10/1987 | Benson et al. | |
| 4,869,171 | A * | 9/1989 | Abouav | 102/215 |
| 5,243,913 | A | 9/1993 | Brent et al. | |
| 5,435,249 | A | 7/1995 | Brent et al. | |
| 5,942,718 | A | 8/1999 | Falquete et al. | |
| 8,091,477 | B2 * | 1/2012 | Brooks et al. | 102/202.7 |
| 8,230,788 | B2 * | 7/2012 | Brooks et al. | 102/202.7 |
| 2005/0178282 | A1 | 8/2005 | Brooks et al. | |
| 2008/0302264 | A1 | 12/2008 | Hummel et al. | |
| 2009/0193992 | A1 | 8/2009 | Moore | |
| 2012/0216696 | A1 * | 8/2012 | Niedermeyer et al. | 102/427 |
| 2013/0255521 | A1 * | 10/2013 | Muller et al. | 102/201 |
| 2013/0319276 | A1 * | 12/2013 | Muller et al. | 102/202.7 |

FOREIGN PATENT DOCUMENTS

| | | |
|---|---|---|
| WO | WO 97/01076 | 1/1997 |
| WO | WO 2006/096920 | 9/2006 |
| WO | WO 2006/128257 | 12/2006 |

OTHER PUBLICATIONS

PCT/IB2011/055576 International Search Report dated May 23, 2012 (5 pages).

PCT/IB2011/055576 International Preliminary Report on Patentability dated Jun. 12, 2013 (11 pages).

U.S. Appl. No. 13/992,794, filed Jun. 10, 2013 entitled "Detonation of Explosives".

U.S. Appl. No. 13/985,705, filed Aug. 15, 2013 entitled "Detonation of Explosives".

PCT/IB2011/055573 International Search Report dated Apr. 2, 2012 (2 pages).

* cited by examiner

DETONATION OF EXPLOSIVES

This application claims priority to International Application No. PCT/IB2011/055573 filed Dec. 9, 2011; South African Application No. 2010/08925 filed Dec. 10, 2010; South African Application No. 2010/08926 filed Dec. 10, 2010; South African Application No. 2010/08927 filed Dec. 10, 2010; and South African Application No. 2011/01370 filed Feb. 21, 2011, the entire contents of each are incorporated herein by reference.

FIELD OF THE INVENTION

This invention relates to detonation of explosives. More particularly, the invention relates to detonator systems for detonating explosives with which they are arranged in a detonating relationship. The invention accordingly provides a detonator system for detonating an explosive charge with which it is, in use, arranged in a detonating relationship. The invention also provides a method of operating a detonator system.

BACKGROUND TO THE INVENTION

Detonation of explosive charges is generally effected by means of detonators which are provided in a detonating relationship with the explosive charges. Such explosive charges usually comprise so-called "main" or "secondary" explosives.

In the mining industry, in particular, as well as in a number of other industries which rely on the use of explosives, e.g. the demolition industry, accurate control of explosives detonation is of great importance, for reasons including safety and accuracy of blasting operation.

Generally speaking, one can distinguish between two types of detonators namely electronic detonators and pyrotechnic detonators.

Electronic detonators, generally, effect detonation of an explosive with which they are in a detonating relationship by generating a voltage spark or plasma in proximity to the explosive. Such voltage spark or plasma is generated by the breakdown of a resistive element or bridge which is provided between two conducting electrodes. The resistive bridge and the electrodes are generally referred to collectively as a "fuse head" which is accommodated within a detonator housing. The plasma generates a shock wave which is transmitted to the proximate explosive and initiates the explosive.

Such electronic detonators generally provide accurate control over detonation, particularly as regards timing and delay properties thereof. However, electronic detonators are expensive to manufacture and difficult to use, requiring a separate or external power source and complex electronic transmission wire connections to allow transmission of electricity to the detonator and permit remote triggering thereof. In the applicant's experience, such detonator connections are prone to failure and may even result in premature initiation of the detonator and thus of the explosive, due to false stimuli, e.g. being provided by radio-frequency (rf) interference on the mining/demolition site.

In contrast to electronic detonators operating by means of an electronic delay system, pyrotechnic detonators employ a series of explosive charges that are located within a detonator housing to provide a desired detonating signal to the main explosive charge at a required timing and delay. The series of explosive charges generally includes (i) an initiating and sealing charge, also known as a priming charge, (ii) a timing charge, (iii) a primary charge and, optionally, (iv) a base charge. The initiating charge serves to initiate the explosive sequence in response to a shock signal transmitted thereto and also functions as a sealing charge which provides a seal to prevent blow-back inside the detonator housing. The initiating charge also initiates the timing charge which provides a desired burning delay for detonation. A timing charge, in turn, initiates the primary charge which either directly provides a detonation initiating signal to the main explosive charge, or initiates the base charge that, in turn, will provide the desired detonation initiating signal to the main explosive charge.

As alluded to above, initiation of the initiating charge of a pyrotechnic detonator is generally effected by imparting a shock signal to the detonator, typically being provided by one or more shock tubes which are located in an initiating relationship with the detonator. The initiating charge then typically comprises a sensitive explosive, initiation of which can be effected by a shock wave of sufficient magnitude. Shock tube is well known and widely used in the initiation of detonators; it comprises a hollow plastic tube lined with a layer of initiating or core explosive, typically comprising a mixture of HMX and aluminium metal powder. Upon ignition of the initiating (core) explosive, a small explosion propagates along the tube in the form of an advancing temperature/pressure wave front, typically at a rate of approximately 7000 ft/s (about 2000 m/s). Upon reaching the detonator, the pressure/temperature wave triggers or ignites the initiating/sealing charge in the detonator, which results in the sequence of ignitions mentioned above and thus eventually causing detonation of the main explosive charge. Although shock tube is economically attractive and easy to use, existing pyrotechnic-based detonator systems do not at all permit the same extent of control of detonation timing and delay which is achieved by using electronic detonators, as the timing and delay features are provided by the detonator explosive charge loading, instead of by electric components.

The present invention therefore seeks, broadly, to provide an approach to operating explosive detonators which addresses and at least partly alleviates the disadvantages associated with both pyrotechnic and electronic initiation of explosive detonators.

SUMMARY OF THE INVENTION

In accordance with a first aspect of the invention, there is provided an explosives detonator system for detonating an explosive charge with which it is, in use, arranged in a detonating relationship and which, on operative acceptance of a detonation initiating signal that has a detonation initiating property, is capable of initiating and thus detonating the explosive charge, the detonator system including an initiating device which is capable of accepting the detonation initiating signal and of initiating and thus detonating the explosive charge, the initiating device being in a non-detonation initiating condition in which it cannot operatively accept the detonation initiating signal and thus assume a detonator initiating condition when the detonation initiating signal is transmitted thereto; and a radio frequency identification (RFID) based switching device that is capable of detecting a switching property of a radio switching signal that is transmitted to the detonator system and that is capable of switching the initiating device, on detection of the detonation initiating property, to a standby condition in which the initiating device is capable of operatively accepting the detonation initiating signal when it is transmitted thereto.

The initiating device may, in particular, comprise an electronic detonation circuit. The detonation circuit may include a primary conductive path that has at least two spaced apart conductive electrodes between which a resistive bridge is provided. The electrodes may be connectable to a voltage source which, when the initiating device is in the standby condition, is capable of generating a detonation initiating voltage difference, as the detonation initiating property, between the electrodes. This voltage difference must exceed the breakdown voltage of the resistive bridge, thereby, in use in the detonation initiating condition, to cause the resistive bridge to generate a voltage spark or plasma capable of causing initiation and detonation of the explosive charge.

The primary conductive path may be open in the non-detonation initiating condition and may be closed by the RFID-based switching device on acceptance of the switching signal, with the initiating device thereby assuming the standby condition.

The RFID-based switching device may include a programmable RFID chip, which is programmed as a switch, and an antenna for the RFID chip. Preferably, the antenna is operatively integrated with the detonation circuit. By operative integration it is meant that the antenna does not exist separately from circuitry providing the detonation circuit, but forms part thereof.

The integrated antenna may provide a secondary conductive path of the detonation circuit, which secondary path is closed in the non-detonator initiating condition.

The RFID-based switching device may, in a particular embodiment of the invention, comprise an RFID tag, being selected from an active RFID rag and a passive RFID tag. When the RFID tag is a passive RFID tag, the antenna, and thus the secondary conductive path of the detonation circuit, comprises a shaped, e.g. coiled, conductive element which is capable of, when it encounters radio waves transmitted to the RFID tag, generating a magnetic field within the antenna, which magnetic field then forms a transient power source from which power may be drawn by the RFID chip for its operation.

The RFID tag may be programmed with at least one of identification information, manufacturing information and operational information relating to the detonator.

The switching property of the radio switching signal may in particular be a predetermined radio frequency of such a signal.

The detonation circuitry may, preferably, be integrated circuitry. Thus, the circuitry may, in one embodiment of the invention, be etched into a substrate of the initiating device. Preferably, however, the integrated circuitry is printed integrated circuitry, being printed onto a substrate by means of ink jet, gravure, screen printing, offset lithography, flexography and other reel to reel methods. The substrate may typically be flexible and may comprise PET, PEN, PI or coated paper. It is to be appreciated that, in such an embodiment, each of the electrodes as well as the detonation circuitry, i.e. conductive paths, are preferably printed.

The voltage source may, in one embodiment of the invention, be an integrated voltage source, being integrated with the primary conductive path.

The voltage source may comprise or include a chargeable or rechargeable component that is chargeable or rechargeable, to its own benefit or to the benefit of the voltage source, on exposure to a charging property of a charging signal, and dischargeable when the initiating device is in the standby condition. The charging signal may, in particular, be a signal component of a shock signal transmitted by shock tube through progressive detonation of an explosive substance contained therein, which shock tube is thus arranged in a charging relationship with the detonator system, e.g. located proximate to the system and, more particularly, to the initiating device. The shock signal transmitted by the shock tube may, in particular, have charging property components including a light pulse, a pressure wave, a product wave including a chemical compositional component, and a temperature wave. The chargeable or rechargeable component may then be sensitive to any one or more of the light pulse, the pressure wave, the product wave and the chemical compositional component. The system may therefore include a shock tube that is arranged in a shock signal transmitting relationship with the initiating device.

It is therefore envisaged that the voltage source may comprise a chargeable component that is chargeable on exposure to the charging property of the charging signal that is transmitted by the shock signal of the shock tube. The voltage source may then, having been charged by the charging property, be dischargeable when the initiating device is in the standby condition. The charging property may, in particular, be the light pulse of the shock signal transmitted by the shock tube, with the shock signal thus being the charging signal. The shock tube may include a photo-luminescent chemical that provides the whole or a part of the light pulse. The photo-luminescent chemical may typically be a fluorescent or a phosphorescent chemical or, alternatively, may be a precursor for a luminescent chemical, in which case it may be capable of transforming into a photo-luminescent chemical under explosive conditions. The photo-luminescent chemical may, in one embodiment of the invention, be inorganic and comprise a rare earth metal salt or combinations of two or more such salts. Typically, the salts may be selected from oxide salts, nitrate salts, perchlorate salts, persulphate salts and combinations thereof. Alternatively, of course, the photo-luminescent chemical may be a precursor for such a salt or another luminescent oxide.

In one embodiment of the invention, the integrated voltage source may be an integrated chargeable or rechargeable voltage source such as a battery or electrochemical cell. The battery may, in particular, be a printed or thin film battery, comprising organic components having been printed or laid onto a substrate that forms part of the detonator system, typically also carrying the initiating device and detonation circuitry. Preferably, the battery is chargeable or rechargeable on exposure to light, i.e. is photosensitive, particularly to the switching light pulse. The battery may therefore include or be operatively associated with or comprise charging components, such a photosensitive cell, such as an organic photovoltaic cell, or other photo-responsive component, such as a transistor, that is capable of charging the chargeable voltage source on exposure to the switching light pulse.

Alternatively, the integrated voltage source may be a passive voltage source, such as a capacitor. The capacitor may be then also be provided or operatively associated with charging components capable of stimulating build-up of charge inside the capacitor which charge, when discharged, will be sufficient to generate the detonation initiating voltage across the resistive bridge. The charging components may then, in particular, also include an organic photovoltaic cell, or other photo-responsive component, such as a transistor, that is capable of charging the chargeable voltage source on exposure to the switching light pulse.

It is to be appreciated that the voltage source therefore typically comprises a chargeable voltage source that is charged by a charging component operatively associated therewith. It is to be appreciated, however, that the voltage source can also be a component that is that is capable of being charged itself in response to the charging signal/property, and being capable itself to apply the detonation initiating voltage across the resistive bridge Thus, in use, electrical energy built up in the voltage source on exposure of the charging component, or the voltage source itself, to the charging property is released once the RFID component switches the initiating device from the non-detonation initiating condition to the standby condition, with the voltage to be generated across the resistive bridge being generated as such by the release. It will be appreciated that through discharge of the charged voltage source, the initiating device thus becomes switched into the detonation initiating condition.

In accordance with a second aspect of the invention, there is provided, in an explosives detonator system comprising an initiating device that is in a non-detonation initiating condition in which it cannot operatively accept a detonation initiating signal but is capable, in a detonation initiating condition caused by operative acceptance of the detonation initiating signal, of causing initiation of an explosive charge with which the detonator system is, in use, arranged in a detonating relationship, a method of operating the detonator system which includes transmitting a radio switching signal having a switching property to a RFID-based switching device of the detonator system whilst the initiating device is in the non-detonation initiating condition; and switching the initiating device into a standby condition by means of the RFID-based switching device on receipt of the switching signal, thereby rendering the detonator system susceptible to operative acceptance of the detonation initiating signal and thus susceptible to being switched into the detonation initiating condition.

The initiating device may, in particular, comprise an electronic detonation circuit which includes a primary conductive path having at least two spaced apart conductive electrodes between which a resistive bridge is provided. The electrodes may be connectable to a voltage source which, when the initiating device is in the standby condition, is capable of generating a detonation initiating voltage difference, as the detonation initiating property, between the electrodes. This voltage difference must exceed the breakdown voltage of the resistive bridge, thereby to cause, in use, the resistive bridge to generate a voltage spark or plasma capable of causing initiation and detonation of the explosive charge.

The electronic detonation circuit may be open in the non-detonation initiating condition, in which case switching of the initiating device into the standby condition includes closing the primary detonation circuit. It will be appreciated that, being open in the non-detonation initiating condition, the primary conductive path is non-conducive to generation of the detonation initiating voltage difference across the resistive bridge.

The switching property of the radio switching signal may, in particular, be a predetermined radio frequency.

In use, the initiating device will thus, according to the detonator system and method of the invention, be incapable of detonating the explosive charge, even if the voltage source is active. In this manner, it is expected that the operational safety of the detonator system is improved in that detonation will not be able to occur until the initiating device has been switched to the standby condition. It is thus only on the standby condition that detonation can be caused to occur.

It will also be appreciated that, in one possible configuration of the invention as it has been broadly described herein, the switching device can be employed in effecting the detonation initiating condition, particularly if the voltage source is active whilst the initiating device is in the non-detonation initiating condition. More particularly, communication of the switching signal to the initiating device will then cause the initiating device to assume the standby condition, which will virtually immediately result in the detonation initiating condition being assumed, because of the activity of the voltage source.

DETAILED DESCRIPTION OF THE INVENTION

The invention will now be described by way of illustrative example only, with reference to the following diagrammatic drawings.

Figure 2:
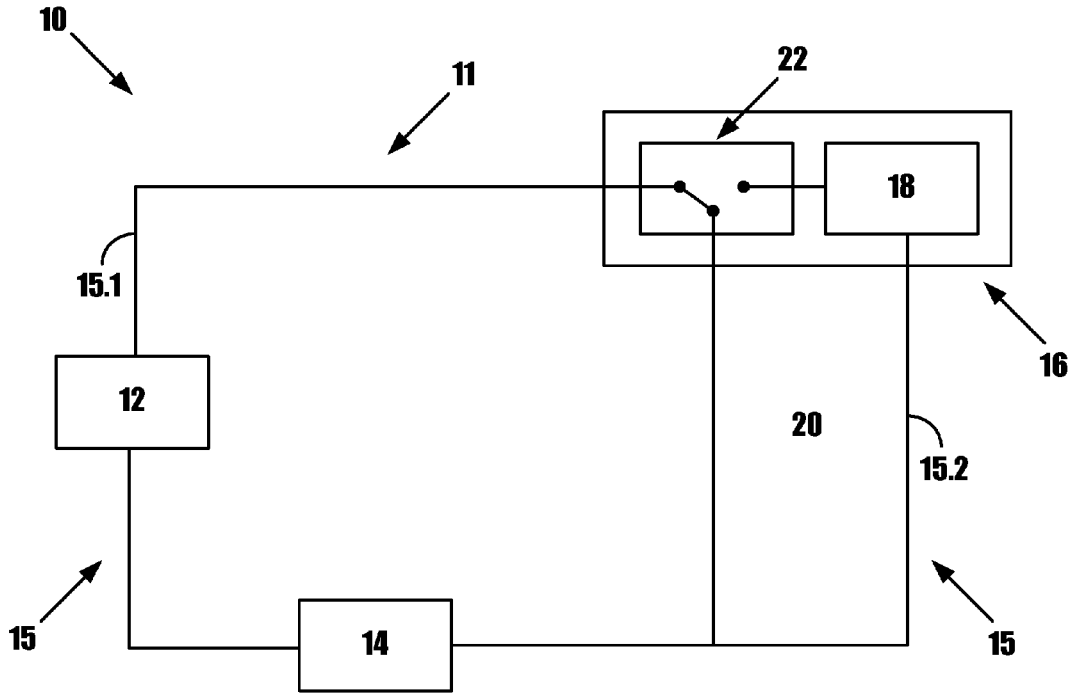

In the drawings,

FIG. 1 shows, conceptually, a detonator system in accordance with the invention in a non-detonation initiating condition; and FIG. 2 shows, conceptually, the detonator system of FIG. 1 in a standby condition.

It is to be appreciated that, with reference to the specification of priority application number ZA 2010/08926, that the non-detonation initiating condition presently described corresponds to the inactive condition described therein, whilst the standby condition presently described corresponds to the active condition described therein. Similarly, the detonator described therein corresponds to the initiating device that is presently described with the fuse head described therein being understood as forming part of the initiating device, as also described below. Further, the conductive 'loops' described in the specification of ZA 2010/08926 correspond to the conductive pathways that are presently described.

Referring now to the drawings, reference numeral 10 generally indicates a detonator system in accordance with the invention.

The system 10 comprises an initiating device 11 that consists of circuitry 15 that forms part of a detonation circuit of the initiating device 11. It is to be appreciated that the initiating device 11, in effect, provides an electronic detonator by means of its functionality hereinafter described.

The detonator circuit 15 comprises a first or primary conductive path or loop 15.1 and a secondary conductive path or loop 15.2. In the primary conductive path 15.1, a voltage source 12 and a fuse head 14 are provided. The fuse head 14 comprises two conductive electrodes (not illustrated), which are spaced apart, and a resistive bridge (not illustrated) that spans the electrodes. The voltage source 12 is capable of generating a voltage difference greater than the breakdown voltage of the resistive bridge between the electrodes such that, in use, a voltage spark or plasma is generated by the resistive element, such a spark or plasma providing a shock wave which causes initiating, and thus also detonation, of an explosive with which the detonating system 10 is arranged in a detonating relationship. It will be appreciated that the voltage difference that is generated by the voltage source 12 constitutes a detonation initiating voltage difference.

The detonation circuitry 15 as well as the fuse head 14, and thus the electrodes and resistive bridge thereof, may, in particular, be printed circuitry, having been printed onto a substrate. Printing may have been achieved by any one or more of inkjet, gravure, screen printing, offset lithography, flexography and other reel to reel methods. The electrodes as well as resistive bridge may, in particular, be printed with a suitable polymeric or conductive ink, or metallization paste which is gold, copper, silver, carbon, stainless steels or aluminium based. When the paste is carbon-based, the carbon may particularly be in the form of nanotubes. The energy output from the resistive bridge could be enhanced by adding a layer printed in a suitable chemical (oxidizer, fuel and or explosive). The substrate may be PET, PEN, PI or coated paper.

The secondary conductive path 15.2 includes an RFID tag 16. The RFID tag 16 operates separately from the voltage source 12 in that it does, preferably at least, not draw electrical power from the voltage source 12, at least not in the non-detonation initiating condition illustrated in FIG. 1.

In particular, the tag 16 comprises an RFID chip 18 and an antenna 20 for the chip 18. The antenna 20 is provided by the secondary conductive path 15.2. It will therefore be appreciated that the antenna of the RFID tag is integrated with the detonation circuitry 15 of the initiating device.

The RFID tag 16 provides a trigger switch 22, typically comprising a suitable programming of the RFID chip 18. The switch 22 is capable of switching the detonation circuitry 15 from a condition where the secondary conductive path 15.2 is closed to a condition in which the primary conductive path 15.1 is closed. Thus, the RFID component is capable of switching the initiating device from the non-detonation initiating condition, as illustrated in FIG. 1, to the standby condition, as illustrated in FIG. 2.

It will be appreciated that, in the non-detonation initiating condition, as illustrated in FIG. 1, the voltage source 12 is not capable of applying any voltage difference over the fuse head 14 as it does not form part of a closed loop with the fuse head 14. Thus, even if the voltage source is inadvertently activated, the fuse head 14 will not cause initiation and thus detonation of the explosive charge. This feature is regarded as a particular benefit of the present invention.

Once the initiation device has then been switched into the standby condition, as is illustrated in FIG. 2, on operative acceptance of the switching radio signal, the voltage source 12 and the fuse head 14 are connected in a closed-loop conductive path provided by the primary conductive path 15.1, which then allows for the voltage difference to be generated over the fuse head 14 and thus for the explosive to be initiated and thus detonated.

In a particular embodiment of the invention, the voltage source 12 may be an integrated voltage source, being integrated with the primary conductive path 15.1.

The voltage source 12 may, in particular, also be a chargeable or rechargeable voltage source. In such a case, the voltage source 12 preferably comprises or is operatively associated with a charging component (not illustrated) that is photo-responsive and, on exposure to a charging property of a charging signal, is capable of charging the voltage source 12, with the voltage source 12 then being dischargeable in sufficient magnitude when the initiating device 16 is in the standby condition to generate the detonation initiating voltage difference across the resistive bridge. Such a charging component may typically be or include a photosensitive cell, such as an organic photovoltaic cell, or other photo-responsive component, such as a transistor.

Alternatively, the charging component itself may be the voltage source 12. Thus, in accordance with the invention, the charging component may also form or form part of the voltage source 12, particularly when the voltage source 12 is a battery that is chargeable or rechargeable, e.g. including a photosensitive material, possible forming part of a photovoltaic cell that is included in the battery.

Electrical energy built up in the chargeable component on exposure to the charging property is thus released once the RFID-based switching device has switched the initiating device from the non-detonation initiating condition to the standby condition. It will be appreciated that through discharge of the charged chargeable component, the initiating device thus becomes switched into the detonation initiating condition.

The charging signal, and thus the charging property, may be provided by a shock signal that is transmitted by shock tube and includes a pressure wave, a light pulse, a temperature wave and a product wave, any one or more of which may provide the charging property, which may thus include a charging pressure, a charging light pulse, a charging temperature, an a charging compositional component. The chargeable component may then be charged by any one or more of such charging properties.

Preferably, the chargeable component will be charged by the light pulse. Thus, the chargeable component may be charged and rendered ready for discharge of the light pulse. In such a case, the chargeable component may therefore typically be operatively associated with a photosensitive transistor, a photodiode, or a photovoltaic cell, as also indicated above.

The shock tube may, particularly for providing sufficient light (energy) for charging the chargeable voltage source, include a photo-luminescent additive that enhances, extends or increases the light energy output of an explosive substance carried inside the shock tube. Such a photo-luminescent additive may include either or both of fluorescent and/or phosphorescent organic or inorganic materials that increase or modify the wavelength of the emitted light pulse or otherwise alter the optical emission properties of the shock tube so as to enhance the light (energy) that is emitted from the shock tube for photovoltaic applications.

It is expected that such a configuration of the present invention is particularly advantageous in that, being integrated with the initiating device 11 and dependent for operation on a signal that is transmittable by shock tube, the requirement for complex wire connections in order to impart electric energy to the initiating device is avoided. In use in such a configuration, the detonator system 10 can therefore conceivable be operated in two possible ways:

(i) Transmit the charging signal to the system 10, thereby charging and rendering ready for discharge the voltage source 12 and thereafter switch the initiating device 11 to the standby condition by means of the RFID-based switching device, thereby allowing for virtually immediate discharge of the charged voltage source 10 and thus for switching of the initiating device 11 into the detonation initiating condition.

(ii) Switching, by means of the RFID-based switching device, the initiating device into the standby condition and, thereafter, transmitting the charging signal to the initiating device 11, thereby charging the voltage source 12, which discharges immediately, once a current load of sufficient magnitude has been reached for generation of the detonation initiating voltage.

It is to be appreciated that application of the detonation initiating voltage would not necessarily lead immediately to detonation of the explosive charge. In this regard, the initiating device 11 may have incorporated therein timing and delay components that are powered by application of the detonation initiating voltage and then, in turn, cause detonation of the explosive.

The present invention therefore envisages a detonation system, such as the detonation system 10, that is capable of being switched from a non-detonation initiating condition, in which it cannot operatively accept a detonation initiating signal, to a standby condition, in which it can operatively accept the detonation initiating signal, with such switching being effected by means of a switching device that is RFID-based which is capable switching the initiating device from the non-detonation initiating condition to the standby condition on detection of a particular radio frequency of a radio switching signal.

The Applicant believes that an approach to detonator system operation as is described herein, i.e. by rendering an initiating device susceptible to initiation only under a predetermined condition, will be particularly beneficial to operational safety of such detonator systems, as inadvertent detonation caused by premature detonation initiating signal transmission will be prevented. The present invention therefore requires operation of a detonator system to proceed along a particular chain of events in order for detonation to result.

The invention claimed is:

1. An explosives detonator for detonating an explosive charge, the detonator including:

an initiating device which comprises a printed electronic detonation circuit that includes a printed primary conductive path;

at least two spaced apart printed conductive electrodes that are included in the primary conductive path;

a printed resistive bridge that is provided between the electrodes and that has a breakdown voltage specification beyond which the resistive bridge breaks down and generates a voltage spark or plasma; and a printed voltage source that is included in the primary conductive path, wherein the initiating device is in a non-detonation initiating condition in which it cannot operatively accept a detonation initiating signal which, when operatively accepted, causes generation of a voltage difference across the electrodes by the voltage source, which voltage difference exceeds the breakdown voltage specification, wherein the detonator further includes;

a radio frequency identification (RFID) based switching device that is programmed as a switch and is sensitive to a switching property of a radio switching signal that is transmitted to the detonator in use, the sensitivity of the RFID based switching device to the switching property being such that, on detection of the switching property, the RFID based switching devices switches the initiating device from the non-detonation initiating condition into a standby condition in which the initiating device can operatively accept the detonation initiating signal and thereby switch into a detonation initiating condition, wherein the voltage source includes an electrically chargeable or rechargeable component that is electrically charged on exposure to a charging property of a charging signal to a magnitude sufficient to generate a voltage difference across the electrodes that exceeds the breakdown voltage specification, the charging signal being a shock signal that is generated, in use, by a shock tube, and wherein the printed electronic detonation circuit is printed onto a substrate, by one or more of inkjet, gravure, screen printing, offset lithography, flexography.

2. The detonator according to claim 1, in which the primary conductive path is open in the non-detonation initiating condition and is closed by the RFID-based switching device on acceptance of the switching signal, with the initiating device thereby assuming the standby condition.

3. The detonator according to claim 1, in which the RFID-based switching device includes a programmable RFID chip, which is programmed as a switch, and an antenna for the RFID chip, with the antenna being operatively integrated with the detonation circuit.

4. The detonator according to claim 3, in which the integrated antenna provides a secondary conductive path of the detonation circuit which is closed in the non-detonator initiating condition.

5. The detonator according to claim 1, in which the RFID-based switching device comprises a RFID tag, being selected from an active RFID tag and a passive RFID tag.

6. The detonator according to claim 5, in which the RFID tag is programmed with at least one of identification information, manufacturing information and operational information relating to the detonator.

7. The detonator according to claim 1, in which the switching property is a predetermined radio frequency of the radio switching signal.

8. A method of operating a detonator according to claim 1 comprising:

transmitting a radio switching signal having a switching property to the RFID-based switching device of the detonator while the initiating device of the detonator is in the non-detonation initiating condition thereby causing the RFID-based switching device to switch the initiating device into the standby condition; and transmitting, as a charging signal, a shock signal generated by the shock tube to the voltage source of the detonator, the shock signal having a charging property which is a signal component of the shock signal and which causes the electrically chargeable or rechargeable component of the voltage source to become electrically charged when it is exposed to the charging property.

9. The method of claim 8, wherein the switching property is a predetermined radio frequency of the radio switching signal.

* * * * *